US007963115B1

(12) United States Patent
Sondergaard et al.

(10) Patent No.: US 7,963,115 B1
(45) Date of Patent: Jun. 21, 2011

(54) MAGNETIC FIELD ENHANCED METAL FUEL COMBUSTION

(75) Inventors: Neal A. Sondergaard, Severna Park, MD (US); William A. Lynch, Cohasset, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 526 days.

(21) Appl. No.: 12/286,275

(22) Filed: Sep. 29, 2008

(51) Int. Cl.
*F01K 13/00* (2006.01)

(52) U.S. Cl. ..... 60/645; 60/670; 123/536

(58) Field of Classification Search ..... 123/536; 60/645, 670
See application file for complete search history.

(56) References Cited

U.S. PATENT DOCUMENTS

| | | | | |
|---|---|---|---|---|
| 4,807,084 | A | 2/1989 | Takechi | |
| 5,426,366 | A | 6/1995 | Overweg et al. | |
| 5,739,997 | A | 4/1998 | Gross | |
| 6,717,781 | B2 * | 4/2004 | Xu et al. | 361/19 |
| 7,900,453 | B1 * | 3/2011 | Lynch et al. | 60/645 |

* cited by examiner

*Primary Examiner* — Michael Cuff
*Assistant Examiner* — James Kim
(74) *Attorney, Agent, or Firm* — Dave A. Ghatt

(57) ABSTRACT

A magnetic flux enhanced metal fuel combustion system and method for producing energy. The energy may be used to drive a water vessel such as a submarine. The system and method includes a ring-shaped coil of an electromagnet surrounding a combustion chamber. The electromagnet produces a magnetic flux within the combustion chamber that limits contact between charged combustion particles and the sidewalls of the chamber, thereby enhancing the combustion of metallic fuels.

15 Claims, 4 Drawing Sheets

MAGNETIC FIELD ENHANCED METAL FUEL COMBUSTION

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

CROSS-REFERENCE TO RELATED APPLICATIONS

This application is related to U.S. nonprovisional patent application Ser. No. 11/272,424 filing date 8 Nov. 2005, hereby incorporated herein by reference, entitled "Air-Independent Fuel Combustion Energy Conversion," joint inventors William A. Lynch and Neal A. Sondergaard.

This application is related to U.S. nonprovisional patent application Ser. No. 11/900,142 filing date 5 Sep. 2007, hereby incorporated herein by reference, entitled "Metal Fuel Combustion and Energy Conversion System," joint inventors William A. Lynch and Neal A. Sondergaard.

TECHNICAL FIELD

The following description relates generally to a method and apparatus for providing metal fuel combustion, more particularly, a magnetic field enhanced combustion system in which a magnetic field is introduced into a combustion chamber for providing more efficient metal combustion.

BACKGROUND

Combustion systems may be used to generate energy to propel commercial and military sea vessels. In combustion systems, fuels typically react with oxidants, such as oxygen or fluorine. In combustion systems in which oxygen is utilized as the oxidant, the oxygen is typically obtained from atmospheric air. In combustion systems for subsurface vehicles such as submarines, it would be advantageous to utilize air-independent oxidation sources.

Solid light-weight metallic fuels such as aluminum and magnesium powder mixtures may be employed in combustion systems. The aluminum type fuel mixture advantageously provides an excellent energy density as a result of the combustion. However, its associated combustion discharge byproduct forms a slag responsible for agglomerating and clogging problems with respect to the exhaust port of the combustor. Clogging and agglomerating also contributes to incomplete combustion. The prior art does not teach a metal combustor that avoids clogging and agglomerating.

SUMMARY

In one aspect, the invention is a metal fuel combustion system for enhancing metal fuel combustion. The system includes a combustion chamber, an electromagnet having a ring-shaped coil arrangement. In this aspect, the ring-shaped coil arrangement surrounds the combustion chamber, and provides a magnetic flux within the combustion chamber. The system further includes a metal fuel source having a metallic fuel, the metal fuel source being attached to the combustion chamber. The system also has an oxidant source having one or more oxidants, the oxidant source being attached to the combustion chamber. In this aspect, the invention includes a working fluid source having working fluid, the working fluid source attached to the combustion chamber. The metal fuel combustion system also includes a first outlet attached to the combustion chamber for discharging combustion gases, and a second outlet at a lower end of the combustion chamber for directing combustion byproducts out of the combustion chamber.

In another aspect, the invention is a method of metal fuel combustion. The method includes the providing of a combustion chamber. The method also includes the feeding of a metallic fuel, working fluid, and one or more oxidants into the combustion chamber. In this aspect, the method further includes igniting a combustion reaction within the combustion chamber using at least the metallic fuel and the one or more oxidants. The method of metal fuel combustion further includes the limiting of contact between reaction particles and inner walls of the combustion chamber by introducing a magnetic flux within combustion chamber.

BRIEF DESCRIPTION OF THE DRAWINGS

Other features will be apparent from the description, the drawings, and the claims.

DETAILED DESCRIPTION

Figure 1A:
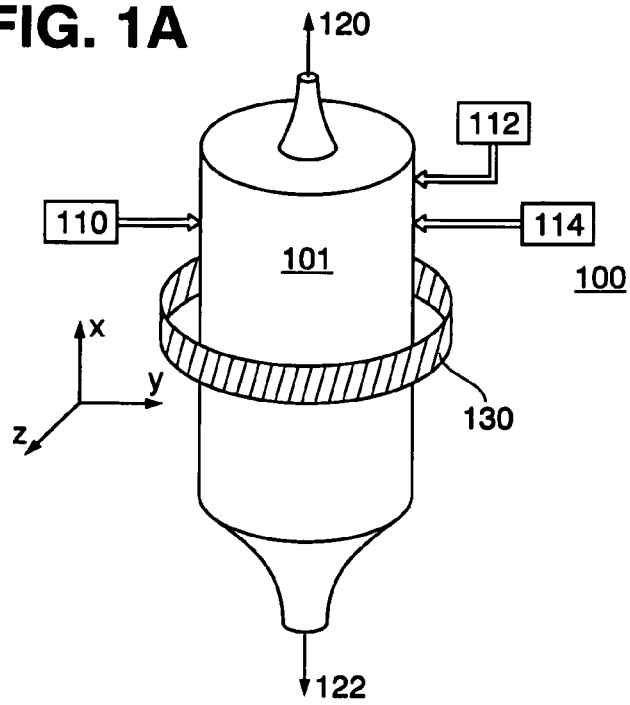
FIG. 1A is a schematic illustration of a magnetic field enhanced metal fuel combustion system, according to an embodiment of the invention.

FIG. 1A is a schematic illustration of a magnetic field enhanced metal fuel combustion system 100, according to an embodiment of the invention. The combustion system 100 provides a general overview of magnetic field enhanced systems according to the invention, and may be employed in water vessels, such as ships or submarines. As shown the system 100 includes a combustion chamber 101 for supporting the combustion of metallic fuel mixtures. Although, the combustion chamber 101 is shown as cylindrical, the combustion chamber 101 may have other shapes, such as for example, rectangular, spherical, or irregular. FIG. 1A shows a working fluid source 110 attached to the combustion chamber 101 for providing working fluid, such as water to the chamber 101. The working fluid source 110 may contain purified and/or de-ionized sea-water.

FIG. 1A shows a metal fuel source 112 attached to the chamber 101 for providing metallic fuel. The metallic fuel may be magnesium, aluminum, or silicon, and combinations thereof. The metallic fuel may comprise for example, a wire made up of a thin walled aluminum tube containing a mixture of silicon, magnesium and possibly aluminum in its core. A sample may be made by drawing molten magnalium under an inert atmosphere into an aluminum tube containing silicon powder under a vacuum. In production, the metallic fuel may be made by drawing through dies and winding on a large take up spool. Lithium and/or boron may be added for increased energy density. In one exemplary embodiment, the fuel may be a pre cordierite alloy with a net composition such as $Mg_2Al_4Si_5$.

FIG. 1A also shows an oxidant source 114 attached to the combustion chamber 101 for providing one or more oxidants to the chamber 101. The oxidant used may be water, but may also be other known oxidants such as liquid oxygen, chlorine or other halides. When water is used as the oxidant, the water may be fed from the water source 110. FIG. 1A also shows a first outlet 120 for discharging combustion gasses from the combustion chamber 101. FIG. 1A also shows a second outlet 122 for discharging combustion byproducts from the chamber 101. The byproducts may be liquid and/or solid. Although only one first outlet 120 and one second outlet 122 are illustrated, the combustion system 100 may include a plurality of first and second outlets for discharging gasses and combustion byproducts.

FIG. 1A also shows a ring-shaped coil assembly 130 at least partially surrounding the combustion chamber 101. The ring-shaped coil assembly 130 is part of an electromagnet, and is used to introduce magnetic flux into the combustion chamber 101. In operation, the magnetic flux captures ionized combustion particles and positions these particles away from chamber walls, thereby reducing clogging and agglomerating. The orientation of the ring-shaped coil assembly 130 may be adjusted to manipulate the magnetic flux pattern within the combustion chamber. FIG. 1A shows x, y, and z axes, about which the coil assembly 130 may be rotated. The coil assembly 130 may also be translated. However it is preferred to locate the coil arrangement at a central location with respect to the combustion chamber 101, with the coil arrangement 130 and the chamber 101 having a substantially center point so that the coil arrangement is concentric with respect to the chamber. As outlined below, the coil assembly 130 may comprise a plurality of coils, and the electromagnet may be a superconducting magnet.

Figure 1B:
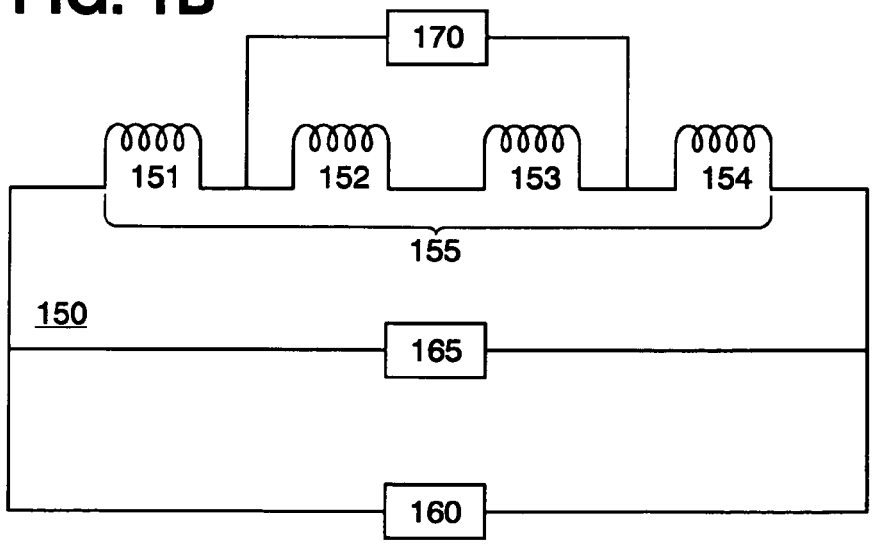
FIG. 1B is a combination block and circuit illustration of an exemplary superconducting magnet that may be incorporated in the magnetic field enhanced metal fuel combustion system, according to an embodiment of the invention.

FIG. 1B is a combination block and circuit illustration of an exemplary superconducting magnet 150 that may be incorporated in the magnetic field enhanced metal fuel combustion system 100, according to an embodiment of the invention. FIG. 1B shows the superconducting magnet 150 having a ring-shaped coil assembly 155 that includes four coils, 151, 152, 153, and 154. Although the ring-shaped coil assembly 155 includes four coils, the assembly may include more than four coils or less than four coils. Additionally, the ring-shaped coil assembly 155 may include one or more magnetic shields to absorb flux leakage. FIG. 1B also shows a power supply 160 and a switch 165, which may be a persistent current switch. The superconducting magnet 150 may also include a current bypass 170. As stated above, the superconducting magnet 150 is used to provide the magnetic flux in the combustion chamber 101, to entrain combustion particles in a desired manner. The superconducting magnet 150 is capable of providing a desired high magnetic flux over a large volume.

Figure 2A:
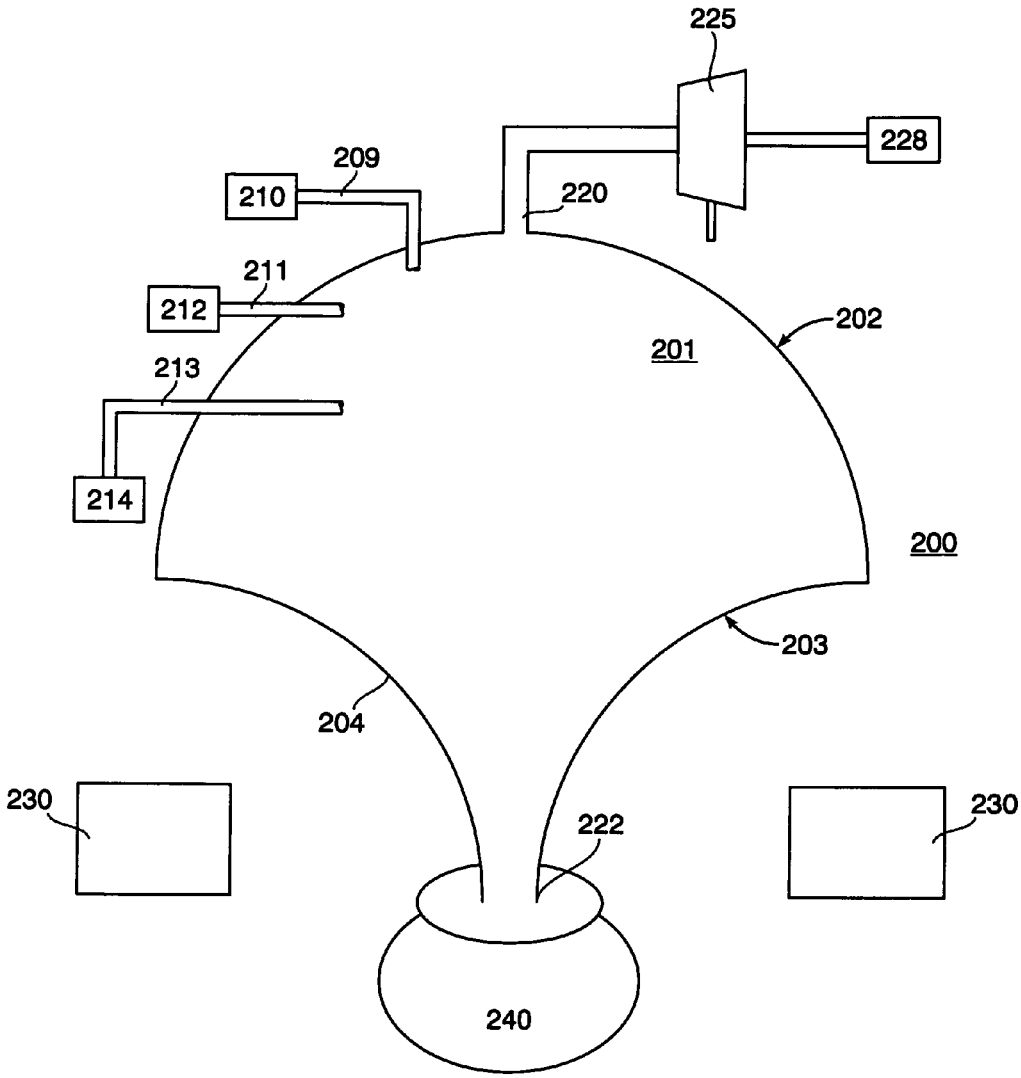
FIG. 2A is a schematic sectional illustration of a magnetic field enhanced metal fuel combustion system, according to an embodiment of the invention.

FIG. 2A is a schematic sectional illustration of a magnetic field enhanced metal fuel combustion system 200, according to another embodiment of the invention. FIG. 2 shows a system 200 having a combustion chamber 201 having an upper spherical portion 202 and a lower cone-shaped portion 203. The lower cone-shaped portion 203 may be used as a filter for filtering combustion byproducts. As shown, the lower cone portion 203 has curved side walls 204. As explained below, the curved side walls 204 combine with flux patterns to enhance the combustion process.

Similar to the system 100, the system 200 includes a working fluid supply 210, a metal fuel supply 212, and an oxidant supply 214. The working fluid, the metallic fuel, and the oxidants supplied by 210, 212, and 214 comprise materials as outlined above with respect to the system 100. The working fluid supply 210 is connected to the combustion chamber 201 via a first inlet 209. Similarly, the metal fuel supply 212 is connected to the combustion chamber 201 via a second inlet 211, and the oxidant supply 214 is connected to the combustion chamber 201 via a third inlet 213. FIG. 2 also shows a first outlet 220, which leads to a turbine 225. The turbine 225 converts thermal energy produced by combustion into mechanical energy, which may be subsequently converted to other forms of energy, such as electrical energy. The turbine 225 may be attached to a generator or a drive train shown at 228. FIG. 2A also shows a byproduct collector 240 for collecting and processing combustion byproducts via a second outlet 222.

Although single inlets 209, 211, and 213 are shown for providing working fluid, metallic fuel, and oxidants respectively, the system 200 may include a plurality of inlets for supplying the chamber with the different combustion elements. Similarly, the system may include a plurality of outlets. For example, a plurality of outlet ports may be provided for directing combustion gasses towards the turbine.

As shown in FIG. 2A, the combustion system 200 also includes a ring-shaped coil assembly 230, which may include a plurality of rings. The ring-shaped coil assembly 230 is positioned so that it surrounds the combustion chamber 201. The coil assembly 230 is preferably positioned so that the coil 230 and the chamber 230 substantially share a single central point so that a concentric relation exist between the coil arrangement 230 and the combustion chamber 201. The ring-shaped coil assembly 230 is part of an electromagnet. The electromagnet may be a superconducting magnet, such as the exemplary magnet 150 shown in FIG. 1B. The electromagnet and associated ring-shaped coil assembly 230 introduces a magnetic flux into the combustion chamber 201.

Figure 2B:
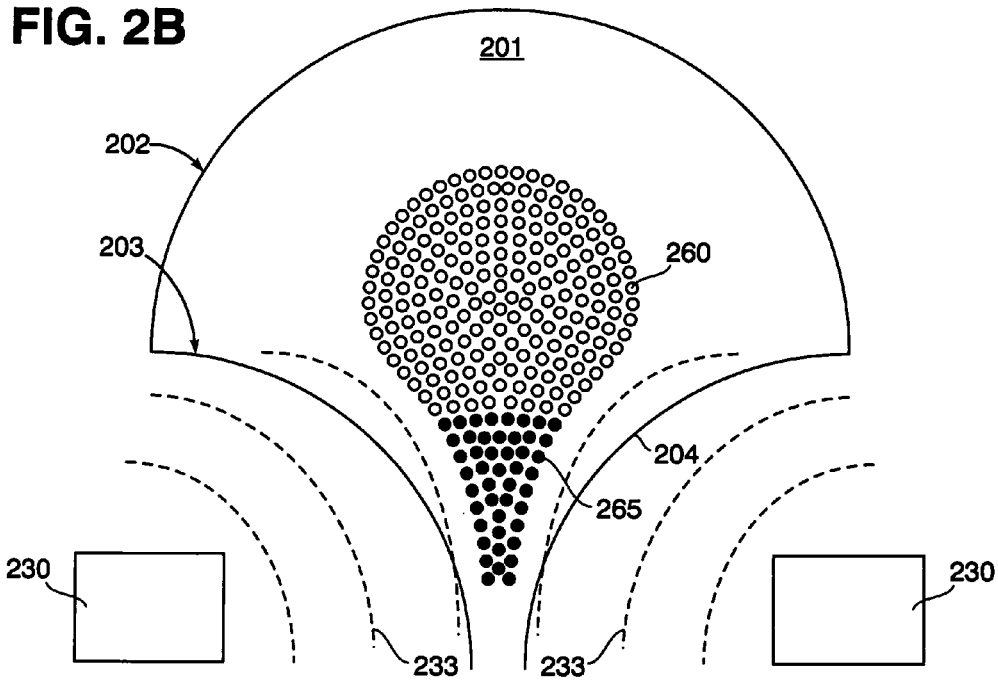
FIG. 2B is an explanatory illustration of a magnetic flux pattern and combustion particles within the combustion chamber, according to an embodiment of the invention.

FIG. 2B is an explanatory illustration of a magnetic flux pattern 233 introduced into the combustion chamber 201 and the flux's influence on combustion particles. FIG. 2B shows the magnetic flux pattern 233 having a curved orientation similar to the curve 204 of the lower portion 203 of the combustion chamber. As shown, the magnetic flux pattern 233 is substantially symmetrically distributed within the combustion chamber 201. FIG. 2B also shows ionized combustion particles 260 entrained by the magnetic flux pattern 233, the particles 260 drawn to the center of the combustion chamber 201 and away from the sidewalls. FIG. 2B further shows combustion byproducts 265 directed downwards through the lower cone-shaped portion 203.

In operation, the combustion system 200 may be used to provide energy to water vessels, including submarines and the like. The system may operate as follows. The electromagnet, which may preferably be a superconducting magnet, is switched on to provide the magnetic flux pattern 233 within the combustion chamber 201. Working fluid, such as water, metallic fuel, and one or more oxidants are fed into the chamber 201 via respective inlets 209, 211, and 213. As stated above, the metallic fuel may include magnesium, aluminum, or silicon, and combinations thereof, which may also include lithium and/or boron. As outlined above, in one particular embodiment, the fuel may be a pre cordierite alloy with a net composition such as $Mg_2Al_4Si_5$.

The combustion in the combustion chamber 201 may take place at temperatures of about 2500° C. to about 3500° C. At these temperatures, ionized combustion particles can form and experience forces that modify their motion, as compared to a similar system without the magnetic field. Due to the magnetic flux present, these moving charged particles experience forces, which slow the motion of the particles. This results in increasing the dwell time of the fuel within the combustion chamber. Furthermore, the magnetic forces on the charged particles compel the particles not to cross the flux lines thus keeping the high temperature particles toward the center of the chamber and away from the walls. Oppositely charged particles would be accelerated in opposite directions and may collide to improve combustion. Magnetically induced circulating currents within larger electrically conductive spinning metal particles could break them into smaller particles to speed combustion and reduce the possibility of agglomeration and this effect may be increased if the magnet is supplied with an AC current source. FIG. 2B shows charged combustion particles 260 entrained by the magnetic flux pattern 233, and held in the middle of the combustion chamber 201. As shown, the curve at the lower portion 203 is similar to the curve of the magnetic flux pattern 233. The magnetic flux pattern 233 is therefore complementary to the shape of the combustion chamber, maximizing the ability to keep particles at the center of the chamber 201. In addition to increasing the dwell time, clogging and agglomeration is decreased because of reduced contact with the sidewalls of the chamber.

Hydrogen and steam produced by the combustion reaction exits the chamber 201 via the first outlet 220, towards the turbine 225. The turbine 225 converts thermal energy produced by combustion into mechanical energy, which powers a drive train or a generator shown at 228. The hydrogen may be utilized in a fuel cell, but a suitable additional oxidant would be needed. Combustion byproducts 265 are disposed via the filter 204 to the byproduct collector 240. When $Mg_2Al_4Si_5$ is used as the fuel, the combustion byproduct is the eutectic cordierite oxide, $Mg_2Al_4Si_5O_{18}$. It should be noted that generally speaking, the operation of the magnetic field enhanced system 200 as outlined is similar to that of system 100.

Figure 3:
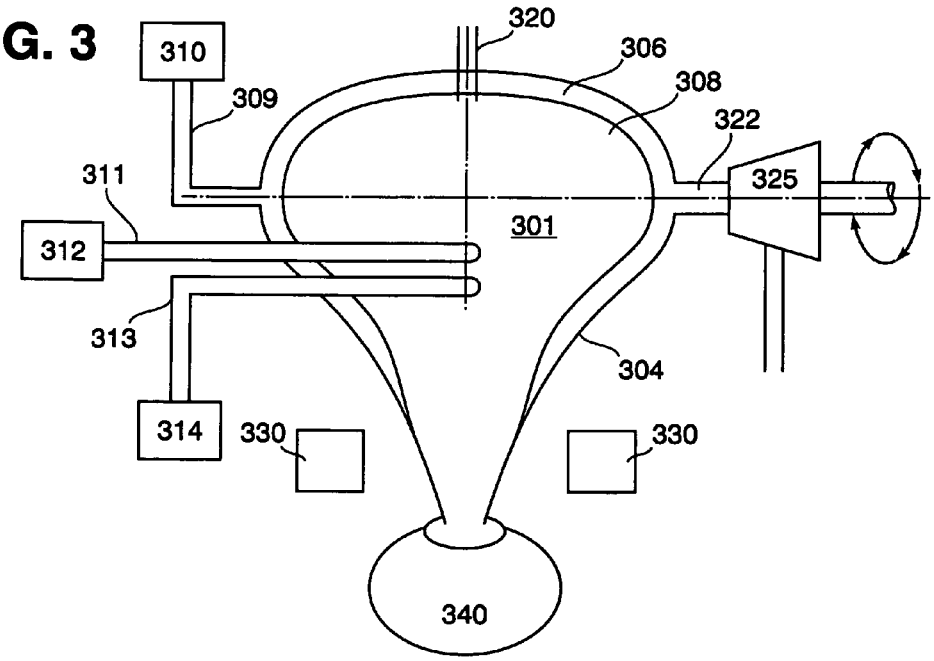
FIG. 3 is a schematic sectional illustration of a magnetic field enhanced metal fuel combustion system according to an embodiment of the invention.

FIG. 3 is a perspective sectional view of a magnetic field enhanced combustion system 300 according to an embodiment of the invention. The combustion system 300 is similar to the systems 100 and 200 outlined above and may also be employed in water vessels, such as ships or submarines. FIG. 3 shows a combustion device 301 for burning metallic fuels, the combustion device 301 including an outer chamber 306 surrounding an inner chamber 308. As shown, the magnetic field enhanced combustion system 300 includes a first inlet 309 that is connected to the outer chamber 306 for directing working fluid, from a working fluid source 310, into the outer chamber 306. The combustion system 300 also includes second and third inlets 311 and 313, respectively. Inlet 311, which is attached to a metal fuel source 312, extends through the outer chamber 306 and extends into the inner chamber 308. Inlet 311 supplies metallic fuel into the inner chamber 308. The inlet 313, which is attached to an oxidant source 314, also extends through the outer chamber 306 into the inner chamber 308. Inlet 313 is used to feed one or more oxidants into the inner chamber 308. The working fluid, the metallic fuel, and the one or more oxidants comprise materials as outlined above with respect to systems 100 and 200.

The magnetic enhanced combustion system 300 further includes a ring-shaped coil arrangement 330. The coil arrangement 330 is part of an electromagnet, similar to the coil arrangements of systems 100 and 200, and is used to provide a magnetic flux pattern within the combustion device 301. The electromagnet associated with the ring-shaped coil 330 is preferably a superconducting magnet. An example of one such superconducting magnet is shown in FIG. 1B. The ring-shaped coil arrangement surrounds a lower portion 304 of the combustion device 301. Similar to the illustration in FIG. 2B, the lower portion 304 has a curved shape similar to the curve of the magnetic flux, thereby maximizing the ability to maintain combustion particles at the center of the combustion device 301.

FIG. 3 also shows the system having a first outlet 320 for directing hydrogen and steam away from the inner chamber 308, and a second outlet 322 for directing steam away from the outer chamber 306. The second outlet 322 may be connected to a turbine 325 for converting the heat energy from the steam to mechanical and/or electrical energy. The system 300 also includes a third outlet 324 for discharging combustion byproducts into a byproduct collector 340. In operation, the magnetic field enhanced combustion system 300 operates similar to operation outlined for system 200, with the magnetic flux reducing clogging and agglomeration, and increasing the residence time of the metallic fuel in the combustion device 301. The outer steam chamber provides steam to the turbine without combustion byproducts such as particulates. It also provides additional insulation in addition to the magnet's cryostat to prevent combustion heat leakage from excessively heating the magnet.

Figure 4:
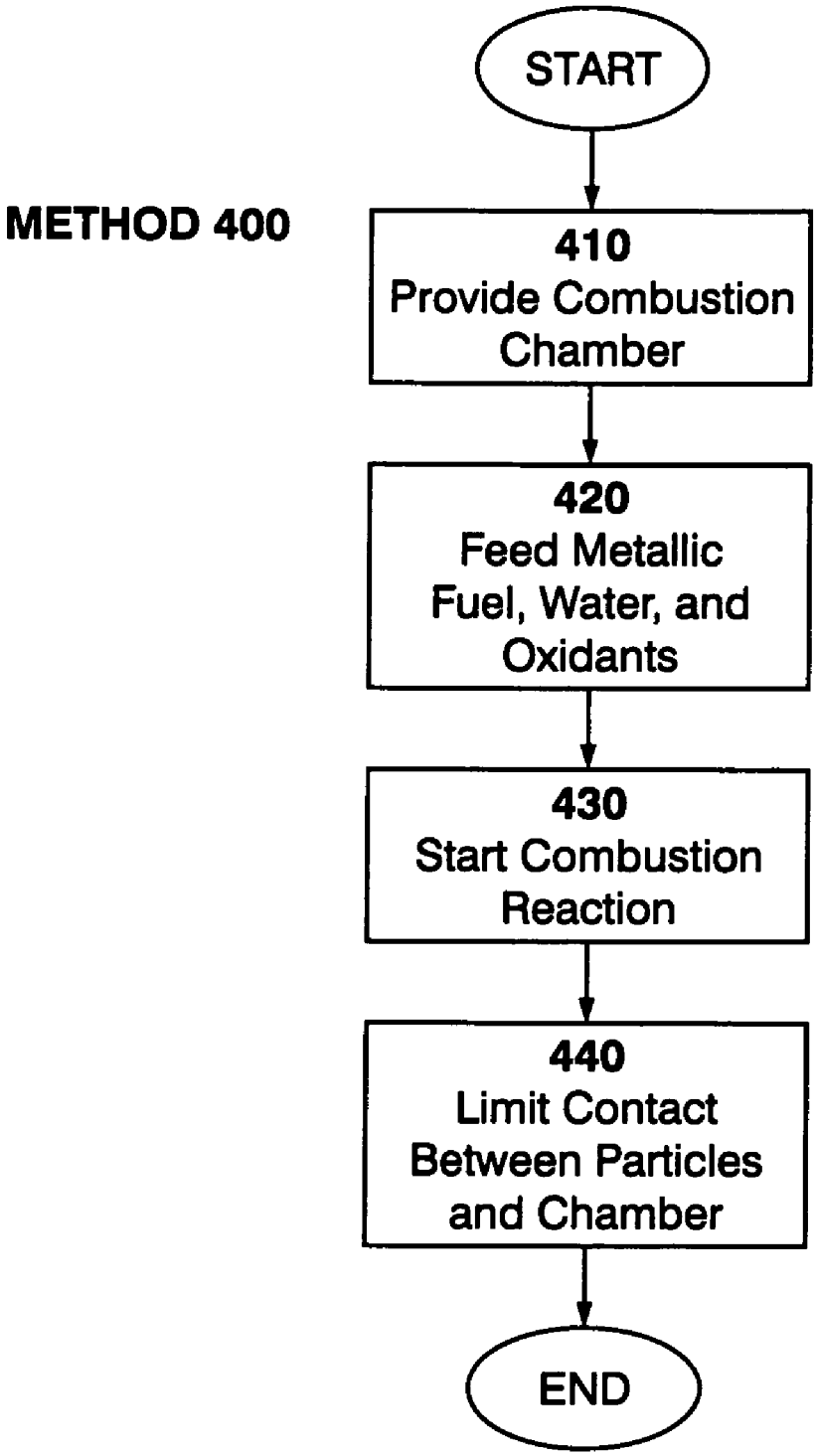
FIG. 4 is a flow chart of metal fuel combustion method, according to an embodiment of the invention.

FIG. 4 is a flowchart illustrating a method 400 of metal fuel combustion. The steps involved in the method 400 have been outlined above in detail in the description with respect to FIGS. 1A-3. Step 410 is the providing of a combustion chamber (101, 201, 301). The combustion chamber may have any desired shape, such as cylindrical, spherical, or irregular. As shown in FIGS. 2A and 3, the combustion chambers (201, 301) may have an upper spherical portion and a lower conical portion.

Step 420 is the feeding of a metallic fuel, water, and one or more oxidants into the combustion chamber (101, 201, 301). Step 430 is the igniting of the combustion reaction within the combustion chamber using the metallic fuel, the one or more oxidants, and the water as reactants. Step 440 is the limiting of contact between reaction particles and the inner walls of the combustion chamber by introducing a magnetic flux within combustion chamber. The magnetic flux is introduced using an electromagnet, preferably a superconducting magnet having a ring-shaped coil arrangement. The ring-shaped coil arrangement is positioned around the combustion chamber thereby introducing a magnetic flux into the chamber.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A metal fuel combustion system for enhancing metal fuel combustion, the system comprising:

a combustion chamber;

an electromagnet having a ring-shaped coil arrangement, the ring-shaped coil arrangement surrounding the combustion chamber for providing a magnetic flux within the combustion chamber;

a metal fuel source having a metallic fuel, the metal fuel source attached to the combustion chamber;

an oxidant source having one or more oxidants, the oxidant source attached to the combustion chamber;

a working fluid source having working fluid, the working fluid source attached to the combustion chamber;

a first outlet attached to the combustion chamber for discharging combustion gases; and a second outlet at a lower end of the combustion chamber for directing combustion byproducts out of the combustion chamber.

2. The metal fuel combustion system of claim 1, wherein the electromagnet comprises a superconducting magnet for providing a high magnetic flux within the combustion chamber.

3. The metal fuel combustion system of claim 2, wherein the metallic fuel comprises:

at least one of Al, Mg, and Si, and combinations thereof, and wherein the ring-shaped coil arrangement is positioned concentrically with respect to the combustion chamber so that said magnetic flux is substantially symmetrically distributed within the combustion chamber and so that charged combustion particles influenced by said magnetic flux are maintained at substantially the center of the combustion chamber thereby reducing contact between combustion particles and inner walls of the combustion chamber.

4. The metal fuel combustion system of claim 3, the system further comprising:

a turbine attached to the first outlet for converting steam energy produced in the combustion chamber into mechanical energy and electrical energy;

a byproduct collector attached to the second outlet for collecting combustion byproducts.

5. The metal fuel combustion system of claim 4, wherein the combustion chamber comprises:

an upper spherical portion; and a lower conical portion attached to the upper spherical portion forming the byproduct outlet, wherein the ring-shaped coil arrangement surrounds the lower conical funnel portion of the combustion chamber, wherein said magnetic flux created by the ring-shaped coil arrangement comprises magnetic flux field lines having curvature lines that substantially match the curvature of the lower conical portion, so that charged combustion particles influenced by said magnetic flux are maintained at substantially the center of the lower conical funnel portion thereby reducing contact between combustion particles and inner walls of the combustion chamber.

6. The metal fuel combustion system of claim 4, wherein the combustion chamber comprises:

an outer chamber; and an inner chamber within the outer chamber, wherein the water source is attached to the outer chamber for directing water from the water source into the outer chamber, and wherein the oxidant source is attached to the inner chamber for directing the one or more oxidants into the inner chamber; and wherein the metal fuel source is attached to the inner chamber for directing the metallic fuel into the inner chamber.

7. The metal fuel combustion system of claim 3, wherein the metal fuel is $Mg_2Al_4Si_5$, and the one or more oxidants comprise water.

8. The metal fuel combustion system of claim 3, wherein the ring-shaped coil arrangement comprises a plurality of coils.

9. A method of metal fuel combustion, the method comprising:

providing a combustion chamber;

feeding a metallic fuel, working fluid, and one or more oxidants into the combustion chamber;

igniting a combustion reaction within the combustion chamber using at least the metallic fuel and the one or more oxidants as reactants; and limiting contact between reaction particles and inner walls of the combustion chamber by introducing a magnetic flux within combustion chamber.

10. The method of claim 9, wherein the introducing of said magnetic flux comprises providing an electromagnetic having a ring-shaped coil arrangement, the ring-shaped coil arrangement positioned around the combustion chamber.

11. The method of claim 10, wherein the electromagnet comprises a superconducting magnet for providing a high magnetic flux within the combustion chamber, and wherein the metallic fuel comprises at least one of Al, Mg, and Si, and combinations thereof.

12. The method of claim 11, wherein in the introducing of the magnetic flux, the ring-shaped coil arrangement is positioned concentrically with respect to the combustion chamber so that said magnetic flux is substantially symmetrically distributed within the combustion chamber and so that charged combustion particles influenced by said magnetic flux are maintained at substantially the center of the combustion chamber thereby achieving said reduced contact between combustion particles and inner walls of the combustion chamber.

13. The method of claim 12, wherein the combustion chamber is provided with an upper spherical portion and a lower conical portion attached to the upper spherical portion, wherein the ring-shaped coil arrangement surrounds the lower conical portion of the combustion chamber, wherein said magnetic flux created by the ring-shaped coil arrangement comprises magnetic flux field lines having curvature lines that substantially match the curvature of the lower conical portion, so that the charged combustion particles influenced by said magnetic flux are maintained at substantially the center of the lower conical portion.

14. The method of claim 13 further comprising:

conducting the combustion reaction at a temperature of about 2500 degrees Celsius to about 3500 degrees Celsius;

converting heat energy produced in the combustion chamber into mechanical energy by using a turbine attached to a first combustion chamber outlet; and collecting combustion byproducts in a byproduct collector attached a second combustion chamber outlet.

15. The method of claim 14, wherein the ring-shaped coil assembly comprises a plurality of coils.

* * * * *